United States Patent [19]

Papendick et al.

[11] 4,163,307

[45] Aug. 7, 1979

[54] DEVICE FOR TENSIONING CORONA-DISCHARGE ELECTRODE ELEMENTS

[75] Inventors: Klaus Papendick, Langen; Lothar Peter, Rodenbach, both of Fed. Rep. of Germany

[73] Assignee: Metallgesellschaft Aktiengesellschaft, Frankfurt am Main, Fed. Rep. of Germany

[21] Appl. No.: 759,271

[22] Filed: Jan. 14, 1977

[30] Foreign Application Priority Data

Jan. 30, 1976 [DE] Fed. Rep. of Germany ..... 2603514

[51] Int. Cl.[2] ..... H01J 9/06

[52] U.S. Cl. ..... 29/25.19; 140/123.5

[58] Field of Search ..... 140/123.5; 29/25.19; 254/104; 269/234

[56] References Cited

U.S. PATENT DOCUMENTS

| | | | |
|---|---|---|---|
| 3,754,427 | 8/1973 | Hunnicutt et al. | 254/93 R |
| 3,762,688 | 10/1973 | Leonhardt | 254/93 R |
| 4,035,886 | 7/1977 | Gluck | 29/25.19 |

*Primary Examiner*—Richard B. Lazarus
*Attorney, Agent, or Firm*—Karl F. Ross

[57] ABSTRACT

The wires or strips (corona-discharge electrode elements) of a corona-discharge electrode are tensioned in the support frame thereof by anchoring one end of each element to a bar of the frame, drawing the other element with a predetermined tension by fluid pressure toward an opposite bar of the frame, and anchoring the latter end to this bar. The tool for tensioning the element comprises a caliper or C-shaped member, one arm of which is provided with a fluid cylinder whose piston bears against the latter bar, and means on at least one arm of the caliber engaging the electrode wire or strip. Preferably the arm opposite that on which the cylinder is provided has means for engaging or guiding the electrode element.

4 Claims, 7 Drawing Figures

DEVICE FOR TENSIONING CORONA-DISCHARGE ELECTRODE ELEMENTS

CROSS-REFERENCE TO RELATED APPLICATION

This application is related to the commonly assigned copending application Ser. No. 726,429 filed Sept. 24, 1976, now U.S. Pat. No. 4,035,886 issued July 19, 1977.

FIELD OF THE INVENTION

This invention relates to a method of and to a device for tensioning and securing corona-discharge electrode elements in the frames of dust-collecting electrostatic precipitators.

BACKGROUND OF THE INVENTION

Generally corona-discharge electrode assemblies are arranged in alternation with collecting-electrode assemblies, sheets, the corona-discharge electrode elements being tensioned by suspended weights or by special frames. The last-mentioned arrangement has the advantage that the corona discharge electrodes can be rapped effectively to clean the same.

All of the corona-discharge electrode elements must be tensioned as uniformly as possible and in such a manner that a safety margin from the ultimate stress is maintained under operating conditions. The tensioning operation, which involves a high labor expenditure, because of the large numbers of electrode elements, must be performed as efficiently as possible.

When the corona-discharge electrode elements (wires or strips) are tensioned by wedges against the frame, which is composed of tubes (German Pat. No. 968,440), the tensioning procedure is very time-consuming because each of the corona-discharge electrode elements must be re-tensioned several times in order to ensure uniform tension and because there is always a danger that individual corona-discharge electrode elements may be overloaded as the wedges are driven.

It is also known to secure corona-discharge wires, like the strings of a harpsichord, in a grid frame consisting of tubular elements and to solder the wires to the frame (German Utility Model 16 00 421). In this case also it is particularly difficult to achieve uniform tension and the operation may result in too-tightly tensioned corona discharge wires and in loose wires, which tend to break, particularly under cyclic loads.

Finally, corona-discharge electrode elements can have specially designed end portions (German Pat. No. 2,044,738), which are arranged in bores of holding frames and to tension these electrodes in that a wedge is driven between the frame and the abutment provided at the end of the corona discharge electrode, which is subsequently welded to the frame, while this practice results in a much-improved manipulation, a sufficiently uniform tension is not always achieved with this method, which also can result in excessively tensioned corona-discharge electrode elements as well as corona-discharge electrode elements which are not sufficiently tensioned.

Specifically, in this latter method the tension of corona-discharge electrode elements tensioned by different workers may vary, so that variations and disadvantages regarding the corona-discharge and cleaning properties result. Besides, the corona-discharge electrode elements cannot always be tensioned and secured by this method so that their corona-discharge points have the intended orientation relative to the tensioning frame.

In the aforementioned copending application, there is described a system which at least partly overcomed the aforedescribed disadvantages by the use of a caliper-type tool, one arm of which engages the corona-electrode element while the other arm serves to tension the element against a bar of the support or holding frame.

OBJECTS OF THE INVENTION

For this reason it is an object of the invention to provide a device for tensioning and securing corona-discharge electrode elements in the corona electrode frames of dust-collecting electrostatic precipitators such that the disadvantages of the prior art are overcome.

Another object of the invention is to provide an improved device or a tool for the tensioning of corona-discharge wires or strips in a support frame, in the fabrication of a corona-discharge electrode for an electrostatic precipitator, which can ensure a constant, well-defined, reproducible tension for each of the electrode elements, independently of the idiosyncrasies of the particular worker and operable even by unskilled personnel.

Yet a further object of the invention is to provide a device for the purposes described which extends the principles set forth in the aforementioned copending application.

SUMMARY OF THE INVENTION

This object is accomplished according to the invention in that one end portion of a corona-discharge electrode element is firmly connected to a holding frame, a second end portion is gripped with a tool which is supported by the holding frame, pressure fluid is supplied to the tool so that the latter tensions, the electrode element, and the second end portion of the corona-discharge electrode element is connected to the holding frame when the corona-discharge electrode element is tensioned. In this way the corona-discharge electrode elements in a holding frame or holding-frame section can be tensioned simultaneously and uniformly.

More specifically, the invention provides a device for the tensioning of the individual corona-discharge electrode elements (wires or strips which usually have spaced-apart discharge points) in a support frame to which one end of each element has been previously anchored, by engaging the other end of the element with one arm of a C-shaped or caliper member, an arm of which carries a fluid-pressure cylinder whose piston bears against a bar of the support frame opposite that at which the element is anchored such that the pressure applied to the cylinder determines the tension on the wire or strip. The end of the strip or wire engaged by the caliper is thereupon fixed to the bar of the frame against which it has been tensioned. The pressure of the fluid medium can then be established such that the static pretension of each corona-discharge electrode element remains below its maximum permissible reverse-bending stress. In this manner all of the corona elements of a support frame or a support-frame segment are uniformly tensioned.

In the method according to the invention, continuous corona-discharge electrode elements extending throughout the height of a holding frame can be tensioned and can be secured in a tensioned state to the outermost tubes of the holding frame and to intermediate tubes thereof. It is preferred to dispose the continuous corona-discharge electrodes in alternation on opposite sides of the center plane of the holding frame and to arrange and secure them in guiding slots or the like formed in the tubes of the holding frame.

The method is suitably carried out by means of a single device or a plurality of devices, each tool comprising an arched member of C-shape (caliper configuration) a bracket rigidly connected to one arm of the arched member, a pressure cylinder firmly connected to the bracket, a piston which is movable in the cylinder under the action of a pressure fluid supplied to the cylinder and carries an abutment disposed outside the cylinder, and means on the other arm of the caliper for gripping the corona-discharge electrode.

The use of a pressure fluid (oil under pressure, compressed air) in a special device in accordance with the invention results in a much-simplified and improved tensioning and securing of corona-discharge electrodes in a holding frame.

The above-mentioned disadvantages of the known methods are avoided, since the tensioning is independent of the operator performing it and for this reason the method of the invention enables an absolutely uniform tensioning of the corona-discharge electrode elements so that the reliability of dust-collecting electrostatic precipitators provided with the tensioned electrodes is much improved.

When wedges were used to tension the corona discharge electrodes it was often required to increase or decrease the tension.

In the practice of the invention, all corona-discharge electrode elements can be tensioned to the same initial stress and any variation in tension which might be due to a yielding of the holding frame can be avoided in that all corona-discharge electrode elements of a frame section or of an entire frame are tensioned at the same time.

The practice of the invention results also in a very considerable saving in working time because a smaller number of manual operations are required and it is no longer necessary to tension each corona-discharge electrode element individually but the groups of corona discharge electrodes or all corona discharge electrodes in a holding frame can be tensioned simultaneously.

SPECIFIC DESCRIPTION

Further details and advantages will be explained more fully with reference to the drawing, in which.

SPECIFIC DESCRIPTION

Figure 1:
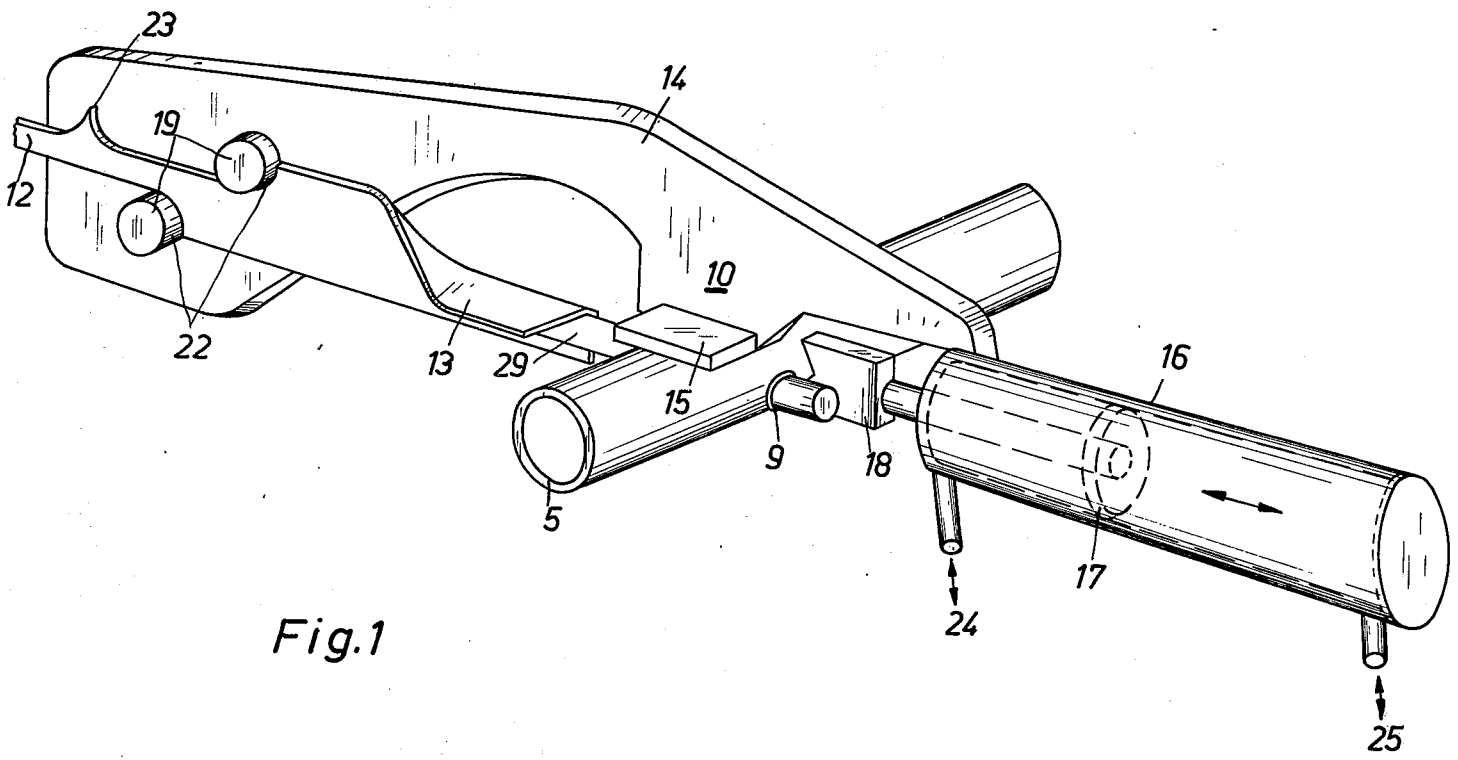
FIG. 1 is a simplified perspective view showing a device according to the invention as used to tension corona-discharge strips having pointed tips.

A corona-discharge strip as shown in FIG. 1 has corona-discharge points 23 and has an end portion 13 to which a rod-shaped extension 29 is welded. This extension is inserted through a bore 9 in a tube or bar 5 of a holding or support frame.

A tensioning tool 10 essentially comprises an arched or caliper member 14, which is provided on one arm with a lateral bracket 15 and on the other arm with two projecting pegs 19. The caliper 14 lies in a plane perpendicular to the bar 5.

A pressure cylinder 16 is rigidly connected to the first arm of caliper 14 and contains a piston 17, which is movable in the cylinder and carries an abutment 18 disposed outside the cylinder.

When it is desired to tension a corona-discharge strip 12, the pegs 19 of the tool 10 are inserted into recesses 22 formed in the corona-discharge strip 12 and the tool is placed on the bracket 15 and the movable abutment 18 and is thus supported by the tube 5 of the holding frame.

Through a fitting 25, pressure fluid (i.e., compressed air or oil under predetermined pressure) is subsequently supplied to the pressure cylinder so that the piston 17 is extended and the cylinder 16 is moved to the right in the drawing together with the arched member 14, which is firmly connected to the cylinder, and the gripped end portion 13 of the corona discharge strip so that the corona discharge strip 12 is moved relative to the tube 5 of the holding frame and is thus tensioned.

As soon as the predetermined tension has been achieved, the rodlike extension 29 of the corona-discharge strip 12 is rigidly connected to the tube 5, e.g., by a short seam weld. In this way, one corona discharge strip after the other is tensioned and secured. As a rule, however, all corona discharge strips of a holding frame are tensioned simultaneously by means of a corresponding number of tools so that all corona discharge strips will be under a uniform tension independently of the displacement of the pistons if the piston areas and the pressures applied are the same in all tools. The cylinders can be connected in parallel for this purpose.

Figure 2:
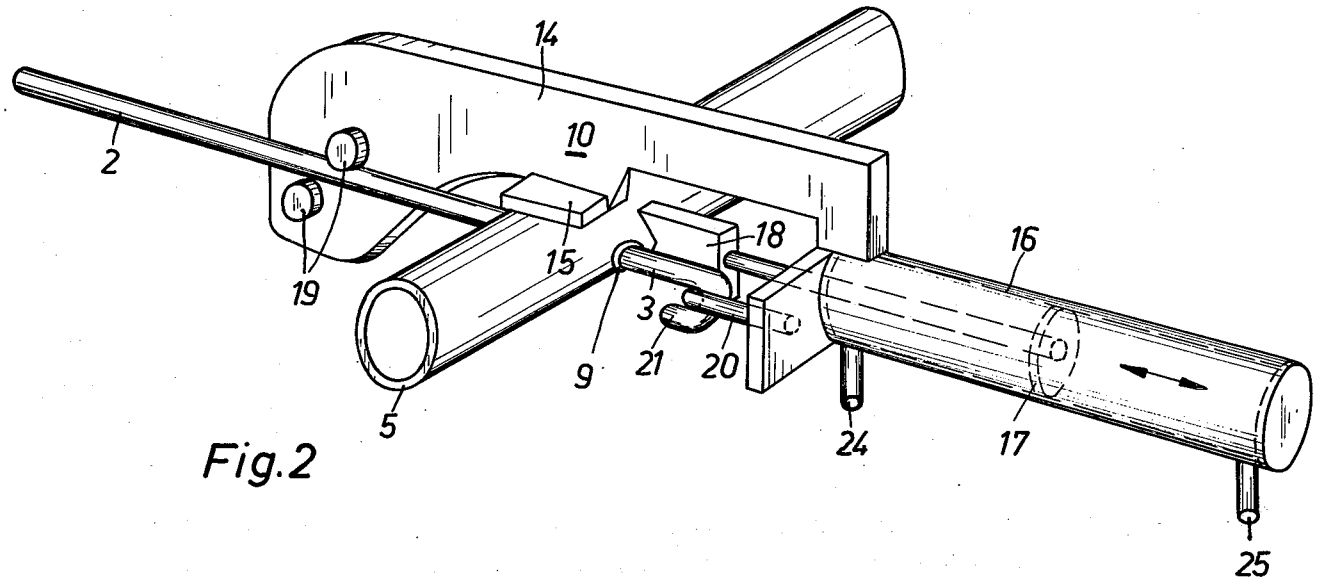
FIG. 2 shows diagrammatically a somewhat modified device for tensioning smooth corona-discharge wires.

FIG. 2 shows a device 10 which serves to tension corona-discharge wires 2 and differs from the device of FIG. 1 only in that a hook 20 is provided, which is firmly connected to the pressure cylinder 16 (i.e., to the first arm of caliper 14) and serves to engage a reversely bent end portion 21 of the corona discharge wire. The projecting pegs 19 serve to guide the device 10 along the corona discharge wire 2. All other reference numerals designate parts which are similar to similarly designated parts in FIG. 1. By means of the device shown in FIG. 2, a tensioning wire is tensioned and secured in the manner which has been described with reference to FIG. 1.

Figure 3:
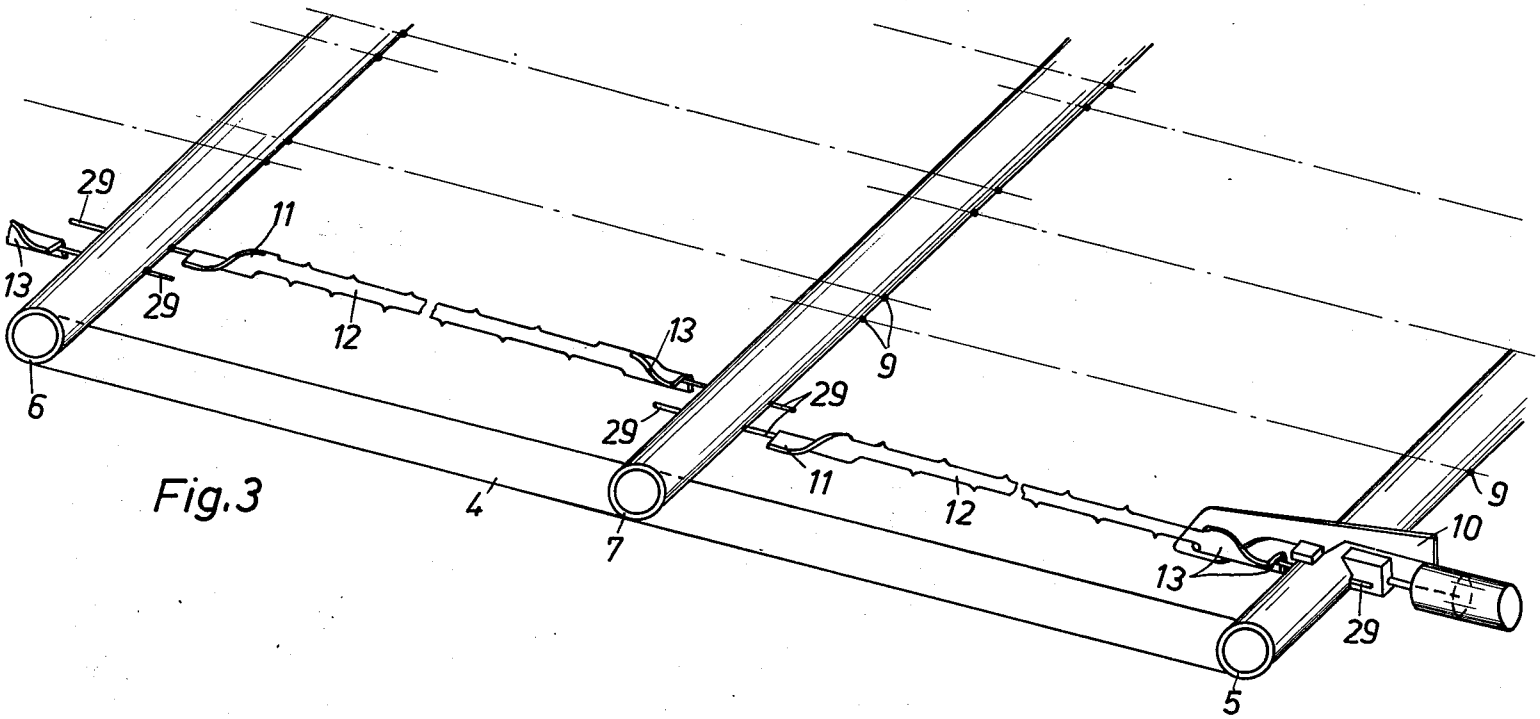
FIG. 3 is a diagrammatic perspective view showing a holding frame in which an electrode element is being tensioned.

FIG. 3 is a fragmentary perspective view showing a portion of a holding frame 4, which comprises an outer tube 5 and intermediate tubes 6 and 7. Corona discharge wires 12 have end portions 11 and 13, which are inserted through bores 9 in the tubes 5, 6, 7 of the holding frame. The bores 9 are disposed approximately in the plane of symmetry of the holding frame 4. This arrangement of the bores 9 is selected to ensure that the holding frame 4 will be symmetrically loaded by the tensioned corona discharge strips 12. Due to that arrangement, the corona discharge strips 12 can be tensioned at a time only between two opposite tubes 5 and 7, and 6 and 7 of the holding frame 4. For this reason, subdivided corona-discharge strips 12 must be used and the strip sections must be provided with special rodlike end portions 29 for forming welded joints. Nevertheless, the tensioning method according to the invention can be successfully performed by means of the device 10 in this case.

Figure 4:
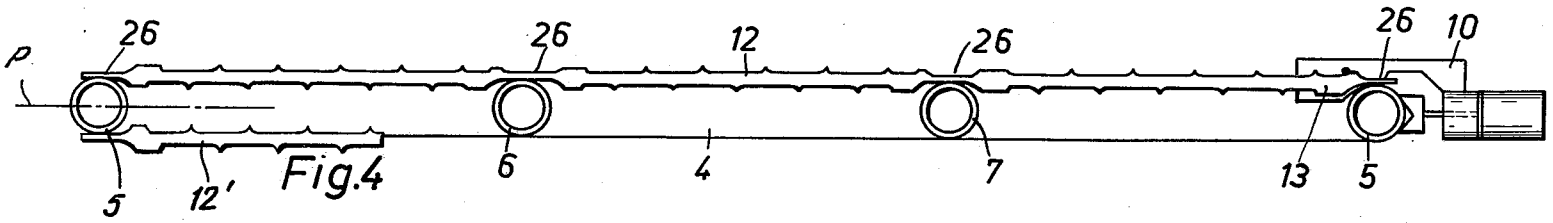
FIG. 4 is a sectional view of the frame showing a holding frame provided with a continuous corona discharge strip.

A further improvement is afforded by the embodiment shown in FIG. 4. In that arrangement, the corona discharge strip 12 extends throughout the length of the holding frame 4, i.e., between the two outer tubes 5, i.e., different from the previous practice the corona discharge strip 12 is located out of the plane of symmetry of the holding frame 4 and is tensioned tangentially to the tubes 5, 6, 7. This tensioning of a continuous strip affords the great advantage that all special rodlike end portions 29 for forming welded joints can be eliminated and a much smaller number of tensioning operations are required.

To improve the connection between the corona discharge strip 12 and the tubes 5, 6, 7, those portions of the strip 12 which are to be fixed are twisted through 90° from the normal orientation of the strip (parallel to the plane of the drawing), so that the latter engages the tubes with wider surfaces, which permit of an improved fixation.

In this arrangement the corona discharge strip 12 to be tensioned and secured is first firmly connected to the left-hand outer tube 5 and is then tensioned throughout its length by means of the device 10. The tensioned corona-discharge strip 12 is then connected to the tubes 6, 7, and the right-hand outer tube 5, e.g., by welding.

As shown in FIG. 4, strips 12', alternating with strips 12, can be provided on the opposite side of the median plane P of the frame.

Figure 5:
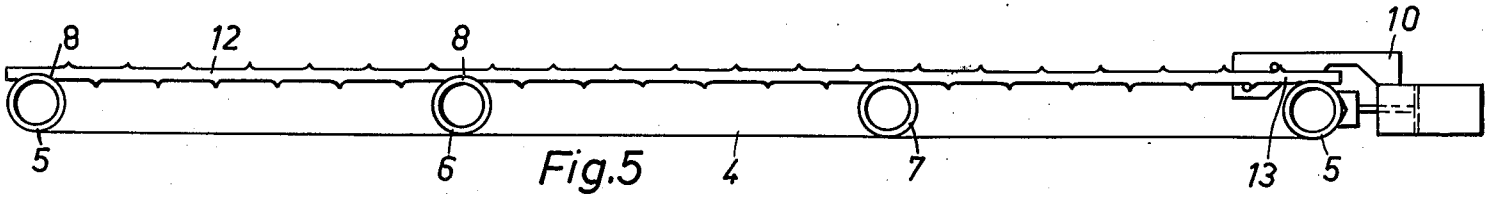
FIG. 5 is a diagrammatic sectional view similar to FIG. 4 showing a holding frame provided with a continuous corona-discharge strip.
Figure 6:
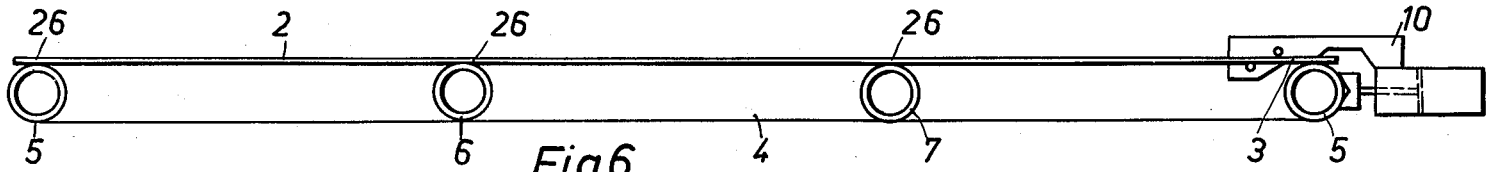
FIG. 6 is a sectional view showing a holding frame provided with a continuous corona discharge wire.

FIGS. 5 and 6 show two further arrangements for tensioning continuous electrodes as shown in FIG. 4. FIG. 5 shows a corona-discharge strip 12 which is oriented throughout its length at right angles to the plane of the holding frame and extends through special slots 8 formed in the tubes 5, 6, 7 and when tensioned is secured, e.g., by spot welds. This modified method affords advantages particularly as regards the storage and transportation of corona discharge strips. In the previously described embodiment, the corona discharge strips can be stored and transported only in an extended condition. On the other hand, the corona discharge strip 12 which is to be tensioned by the method illustrated in FIG. 5 may be uniform throughout its length so that it can be wound and can be processed in length portions withdrawn from a roll. This practice results also in a saving of material compared with the supply of fixed lengths.

It will be understood that continuous corona-discharge wires can also be used in the manner which has been described with reference to FIGS. 4 and 5 for corona discharge strips. It is apparent from FIG. 6 that slots 8 in the tubes 5, 6, 7 are not required where corona-discharge wires are used and it is sufficient to tension these wires tangentially to the tubes 5, 6, 7 and to join the wires to the tubes at the fixing portions 26.

Figure 7:
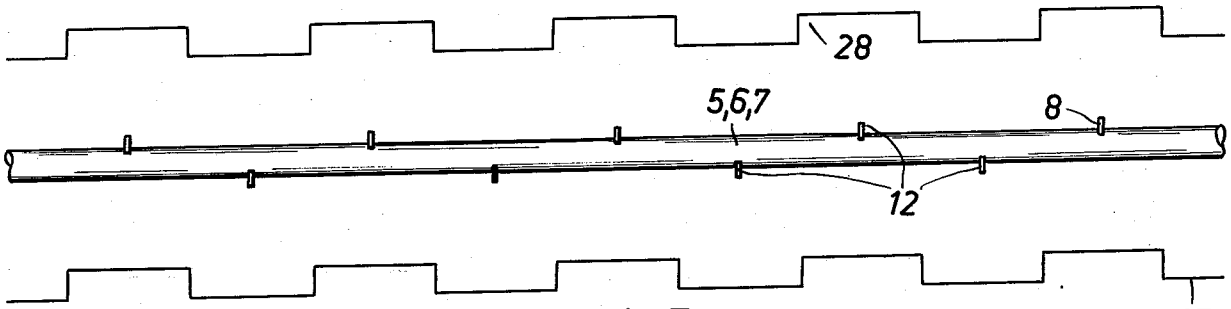
FIG. 7 is a diagrammatic fragmentary sectional view showing a portion of a dust-collecting electrostatic precipitator viewed on a plane which is at right angles to the corona-discharge strips.

FIG. 7 shows an arrangement in which continuous corona-discharge electrodes are arranged in alternation on opposite sides of the tubes 5, 6, 7 of the holding frame 4 in an arrangement which conforms to collecting electrodes 26, which have a meandering shape in cross-section. In accordance with FIG. 5, the corona-discharge strips 12 extend through slots 8 in the tubes 5, 6, 7 and are thus offset by about one-half of the diameter of the tubes 5, 6, 7 from the plane of symmetry of the holding frame 4. As a result, two adjacent corona discharge strips 12 are offset by about the entire diameter of the tube. As a result, the collecting electrodes may be formed with dust-collecting recesses 28 in a depth which corresponds to the tube diameter so that dust can be collected under optimum conditions. For this reason the alternating arrangement of asymmetrical continuous corona-discharge electrodes contemplated in the method according to the invention results in great advantages also in the general design of dust-collecting electrostatic precipitators.

We claim:

1. The combination with an elongated corona-discharge electrode, anchored at one end to a bar, in a support frame having another bar parallel to but spaced from the first-mentioned bar, for use in an electrostatic precipitator, of a tool for tensioning said electrode, said tool comprising:

an elongated caliper having a first arm at one end of the caliper and a second arm at the other end of the caliper;

a fluid-pressure cylinder mounted on said first arm and provided with a piston having an abutment bearing against said other bar of said frame perpendicularly thereto, said cylinder extending parallel to said electrode;

an engaging member on one of the arms of said caliper engaging and entraining an unanchored opposite end of said electrode for tensioning same against said other bar;

positioning means on said second arm engaging said electrode for orienting said caliper relative to said electrode and vice versa;

a laterally extending bracket fixed to said caliper for orienting said caliper relative to said other bar in a plane generally perpendicular thereto; and means for supplying fluid to said cylinder under pressure whereby said abutment is pressed against said other bar and said electrode is tensioned in accordance with the pressure applied to said cylinder.

2. The combination defined in claim 1 wherein said engaging member is a hook fixed on said first arm and engageable with another hook formed on said opposite end of said electrode.

3. The combination defined in claim 1 wherein said engaging member is a pin formed on said second arm, said positioning means on said second arm including at least one further pin, said electrode being received between said pins.

4. The combination defined in claim 1 wherein said positoning means on said second arm includes a pair of pins receiving said electrode between them.

* * * * *